US008390423B2

(12) United States Patent
Fartash et al.

(10) Patent No.: US 8,390,423 B2
(45) Date of Patent: Mar. 5, 2013

(54) NANOFLAT RESISTOR

(75) Inventors: Arjang Fartash, Corvallis, OR (US); Peter Mardilovich, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/321,461

(22) PCT Filed: May 19, 2009

(86) PCT No.: PCT/US2009/044570

§ 371 (c)(1),
(2), (4) Date: Nov. 18, 2011

(87) PCT Pub. No.: WO2010/134910

PCT Pub. Date: Nov. 25, 2010

(65) Prior Publication Data

US 2012/0062355 A1 Mar. 15, 2012

(51) Int. Cl.
*H01C 1/012* (2006.01)

(52) U.S. Cl. ..... 338/314; 347/63; 347/62

(58) Field of Classification Search ..... 338/314
See application file for complete search history.

(56) References Cited

U.S. PATENT DOCUMENTS

| | | | | |
|---|---|---|---|---|
| 4,514,741 | A | 4/1985 | Meyer | |
| 5,122,409 | A | 6/1992 | Akutsu et al. | |
| 5,751,315 | A | 5/1998 | Burke et al. | |
| 5,861,902 | A | 1/1999 | Beerling | |
| 6,070,969 | A | 6/2000 | Buonanno | |
| 6,161,924 | A | 12/2000 | Mitani et al. | |
| 6,610,463 | B1 * | 8/2003 | Ohkura et al. | 430/322 |
| 6,643,165 | B2 * | 11/2003 | Segal et al. | 365/151 |
| 7,195,343 | B2 | 3/2007 | Anderson et al. | |
| 7,390,078 | B2 | 6/2008 | Bell et al. | |
| 7,982,209 | B2 * | 7/2011 | Herner et al. | 257/14 |
| 8,172,370 | B2 * | 5/2012 | Reitmeier | 347/63 |
| 2008/0026136 | A1 | 1/2008 | Skamser et al. | |
| 2008/0122900 | A1 | 5/2008 | Piatt et al. | |

FOREIGN PATENT DOCUMENTS

| | | | |
|---|---|---|---|
| KR | 10-2002-0088374 | A | 11/2002 |
| WO | 02098665 | A1 | 12/2002 |

OTHER PUBLICATIONS

Hernandez-Velez, M.; "Nanowires and 1D arrays fabrication: An Overview"; Oct. 6, 2005; p. 51-63; vol. 495; Thin Solid Films.

Kokonou, M. et al.; "Few nanometer thick anodic porous alumina films on silicon with high density of vertical pores"; Dec. 21, 2007; p. 3602-3606; vol. 515; Thin Solid Films.

Masuda, Hideki et al.; "Ordered Metal Nanohole Arrays Made by a Two-Step Replication of Honeycomb Structures of Anodic Alumina"; Jun. 9, 1995; p. 1466-1495; vol. 268; Science; http://www.sciencemag.org/cgi/content/abstract/268/5216/1466.

Silvestri, V.J. et al.; "Deposition Techniques and Heat Transfer Properties of Porous Aluminum"; May 1982; p. 1029-1026; vol. 129; J. Electrochem. Soc.; Pittsburgh, PA U.S.A.

Borca-Tasciuc, D.A. et al.; "Anisotropic thermal properties of nanochanneled alumina templates"; Apr. 1, 2005; p. 084303-2-084303-9; vol. 97, Jounal of Applied Physics.

Ram, K. Bhargava et al.; "Non-lithographic Nanofabrication Using Porous Alumina Membranes"; 2006; p. 142-146; vol. 900E; Materials Research Society; http://www.mrs.org/s_mrs/sec_subscribe.asp?CID=6225&DID=173033&action=detail.

* cited by examiner

*Primary Examiner* — Kyung Lee

(57) ABSTRACT

A nanoflat resistor includes a first aluminum electrode (360), a second aluminum electrode (370); andnanoporous alumina (365) separating the first and second aluminum electrodes (360, 370). A substantially planar resistor layer (330) overlies the first and second aluminum electrodes (360, 370) and nanoporous alumina (365). Electrical current passes from the first aluminum electrode (360), through a portion of the planar resistor layer (350) overlying the nanoporous alumina (365) and into the second aluminum electrode (370). A method for constructing a nanoflat resistor (390) is also provided.

20 Claims, 10 Drawing Sheets

NANOFLAT RESISTOR

RELATED APPLICATION

The present application is a nationalization under 35 U.S.C. §371 of, and claims the priority of, PCT/US2009/044570, filed May 19, 2009, entitled "Nanoflat Resistor," which is incorporated herein by reference in its entirety.

BACKGROUND

Thermal inkjet technology is widely used for precisely and rapidly dispensing small quantities of fluid. Thermal inkjets eject droplets of fluid out of a nozzle by passing an electrical current through a heating element. The heating element generates heat which vaporizes a small portion of the fluid within a firing chamber. The vapor rapidly expands, forcing a small droplet out of the firing chamber nozzle. The electrical current is then turned off and heating element cools. The vapor bubble rapidly collapses, drawing more fluid into the firing chamber from a reservoir. During printing, this ejection process can repeat thousands of times per second. It is desirable that the heating element be mechanically robust and energy efficient in ejecting droplets.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
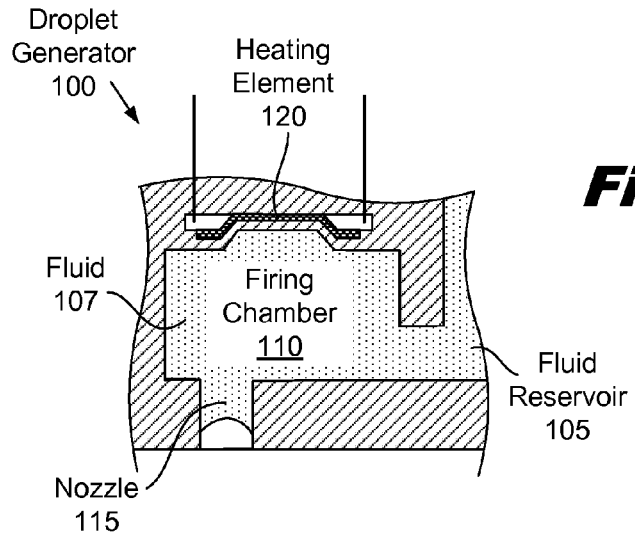
FIGS. 1A-1C are illustrative diagrams of the operation of a thermal inkjet droplet generator, according to one embodiment of principles described herein.

The printhead used in thermal inkjet printing typically includes an array of droplet generators connected to one or more fluid reservoirs. Each of the droplet generators includes a heating element, a firing chamber and a nozzle. Fluid from the reservoir fills the firing chamber. To eject a droplet, an electrical current is passed through a heater element placed adjacent to the firing chamber. The heating element generates heat which vaporizes a small portion of the fluid within the firing chamber. The vapor rapidly expands, forcing a small droplet out of the firing chamber nozzle. The electrical current is then turned off and the resistor cools. The vapor bubble rapidly collapses, drawing more fluid into the firing chamber from a reservoir. During printing, this ejection process can be repeat thousands of times per second.

A minimum energy is usually required to fire ink drops of proper volume from the thermal inkjet printhead. This minimum energy is referred to as the "turn on energy". The turn on energy must be sufficient to locally superheat the fluid to achieve reliable and repeatable vaporization. Undesirable thermal losses from the heating element lead to higher turn on energies and lower efficiency in converting the electrical pulses into mechanical forces which eject the droplet.

The mechanical robustness of the heating element is another design consideration. The heating elements are subjected to high frequency forces as a result of the vapor expansion and subsequent cavitation which occurs with each droplet ejection. These forces can result in surface erosion and failure of the heating elements. When a heating element fails, no droplets can be ejected from the firing chamber and the overall printing quality of the thermal inkjet printhead suffers.

The present specification relates to a flat heating element above nano-porous anodized alumina. This resistor design has been dubbed a "nanoflat resistor." According to one illustrative embodiment, the nanoporous anodized alumina increases the thermal isolation of the resistive heating element. This decreases the turn on energy of the nanoflat resistor and increases the energy efficiency. The flat topography of the nanoflat resistor eliminates shoulders or other discontinuities which can be susceptible cavitation induced damage and failure. Consequently, the thermal inkjet devices which incorporate nanoflat resistors may achieve higher energy efficiency and greater reliability.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

FIG. 1A is a cross-sectional view of one illustrative embodiment of a droplet generator (100) within a thermal inkjet printhead. The droplet generator (100) includes a firing chamber (110) which is fluidically connected to a fluid reservoir (105). A heating element (120) is located in proximity to the firing chamber (110). Fluid (107) enters the firing chamber (110) from the fluid reservoir (105). Under isostatic conditions, the fluid does not exit the nozzle (115), but forms a concave meniscus within the nozzle exit.

Figure 1B:
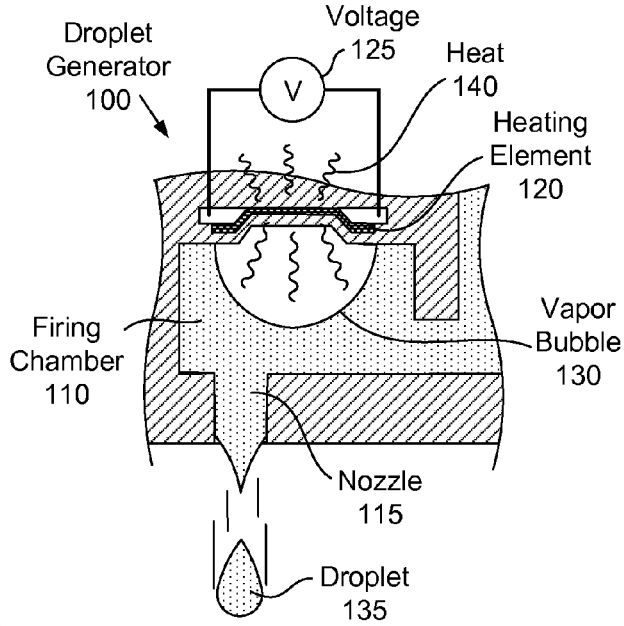

FIG. 1B is a cross-sectional view of a droplet generator (100) ejecting a droplet (135) from the firing chamber (110). According to one illustrative embodiment, a droplet (135) of fluid is ejected from the firing chamber (110) by applying a voltage (125) is applied to the heating element (120). The heating element (120) can be a resistive material which rapidly heats due to its internal resistance to electrical current. Part of the heat generated by the heating element (120) passes through the wall of the firing chamber (110) and vaporizes a small portion of the fluid immediately adjacent to the heating element (120). The vaporization of the fluid creates rapidly expanding vapor bubble (130) which overcomes the capillary forces retaining the fluid within the firing chamber (110) and nozzle (115). As the vapor continues to expand, a droplet (135) is ejected from the nozzle (115).

The energy efficiency and ejection frequency of the droplet generator (100) is at least partially determined by the efficiency of the heating element (120) in converting electrical energy into mechanical force which ejects the droplet (135). A number of energy losses can occur, including the transmission of heat (140) from the heating element upward into the body of the thermal inkjet printhead. This heat is not converted into useful energy and is lost. This lost heat can dissipate into other components within the thermal inkjet and undesirably alter their temperatures.

Lowering the amount of lost heat can make it easier to maintain the thermal inkjet printhead at a substantially isothermal state and reduce undesirable changes in the printing performance of the printhead. By increasing the proportion of the heat which passes into the fluid, less electrical current is required to fire a droplet. This increases the efficiency of the individual firing chamber (110) and reduces overall amount of heat produced by the droplet generator (100).

Figure 1C:
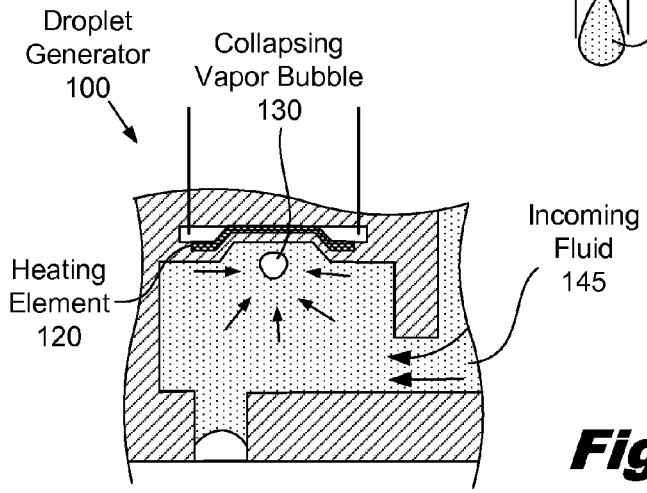

As shown in FIG. 1C, following the ejection of the droplet (135), the electrical current through the heating element (120) is cut off and the heating element (120) rapidly cools. The vaporized bubble rapidly collapses, pulling additional fluid (145) from the reservoir (105) into firing chamber (110) to replace the fluid volume vacated by the droplet (135, FIG. 1B). The droplet generator (100) is then ready to begin a new droplet ejection cycle.

A plurality of droplet generators (100) may be contained within a single inkjet die. The droplet ejection cycle described above can occur thousands of times in a second. This high frequency expansion and collapse of vapor bubble in proximity to the heating element (120) can subject it to significant mechanical stress. Particularly, the expansion and collapse of the vapor bubble can produce a shockwave which is transmitted through the liquid to the heating element. Over the design lifetime of the droplet generator (100) it can be expected eject tens of billions of droplets. Failure of the heating element (120) due to mechanical stress of repeated high frequency shock waves results in the failure of the droplet generator, with a subsequent loss of overall printing quality of the thermal inkjet printhead. Consequently, it is desirable that the heating element be mechanically robust to increase its lifetime.

Figure 2A:
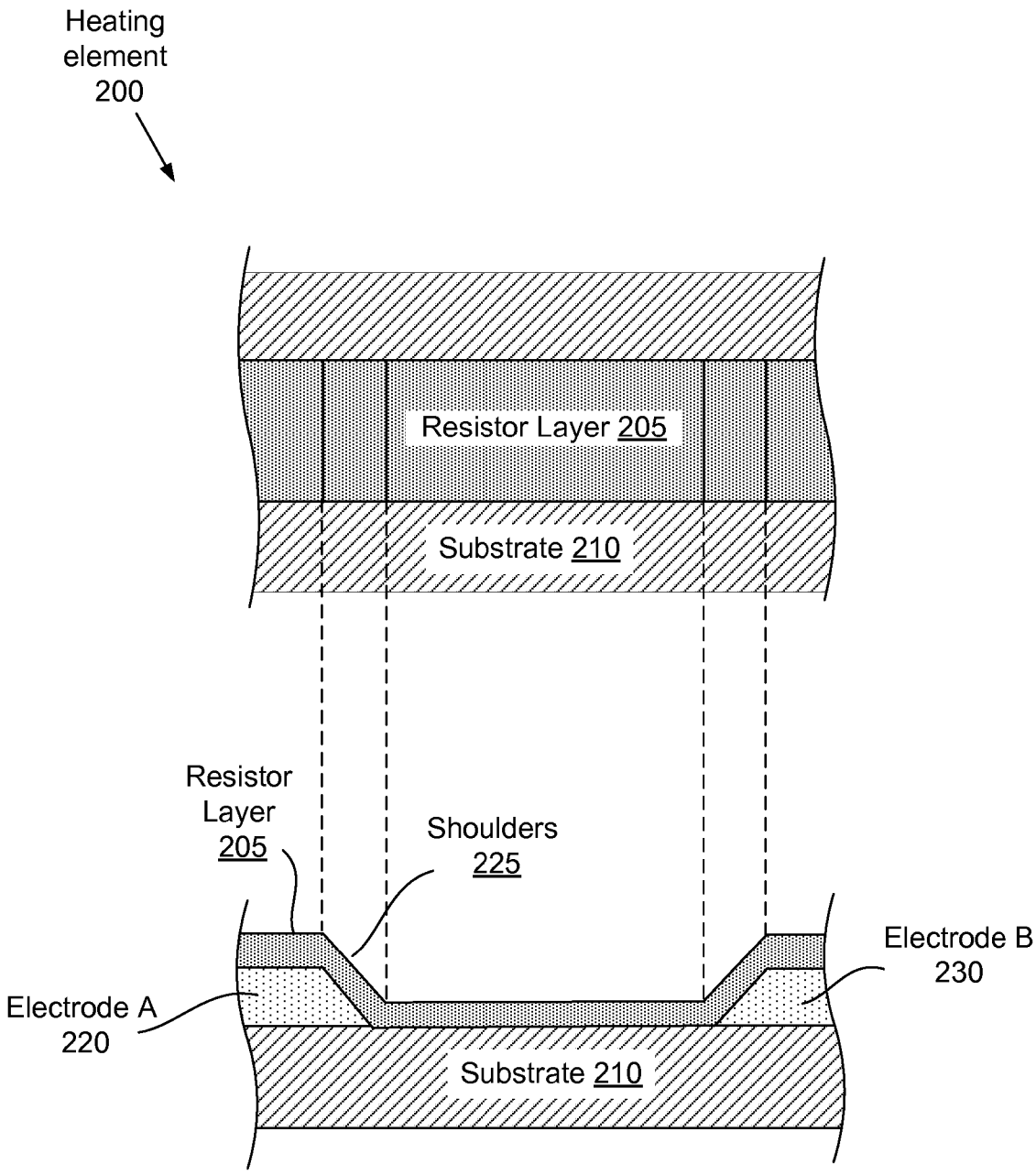
FIG. 2A is a diagram depicting a top view and a cross-sectional view of an illustrative thermal inkjet resistor with beveled topography, according to one embodiment of principles described herein.

FIG. 2A is a top view and cross-sectional view of an illustrative heating element (200) with a beveled topography. According to one illustrative embodiment, the heating element (200) is formed over a substrate (210). Two electrodes (220, 230) are formed with beveled ends. A layer of resistive material (205) is deposited over the gap between the two electrodes. The beveled ends create a convenient transition which maintains the continuity of the deposited resistive material (205) across the heating element (200). A voltage is applied across the electrodes (220, 230) and flows through the resistive material (205). The resistive material (205) generates heat in proportion to the amount of electrical current which passes through it.

However, the beveled ends of the electrodes (220, 230) create shoulders which protrude into the firing chamber (110, FIG. 1A). These shoulders (225) are a discontinuity in the surface of the heating element. The shoulders (225) can be particularly susceptible to the repeated shockwaves generated by during the operation of the droplet generator (100, FIG. 1A).

Figure 2B:
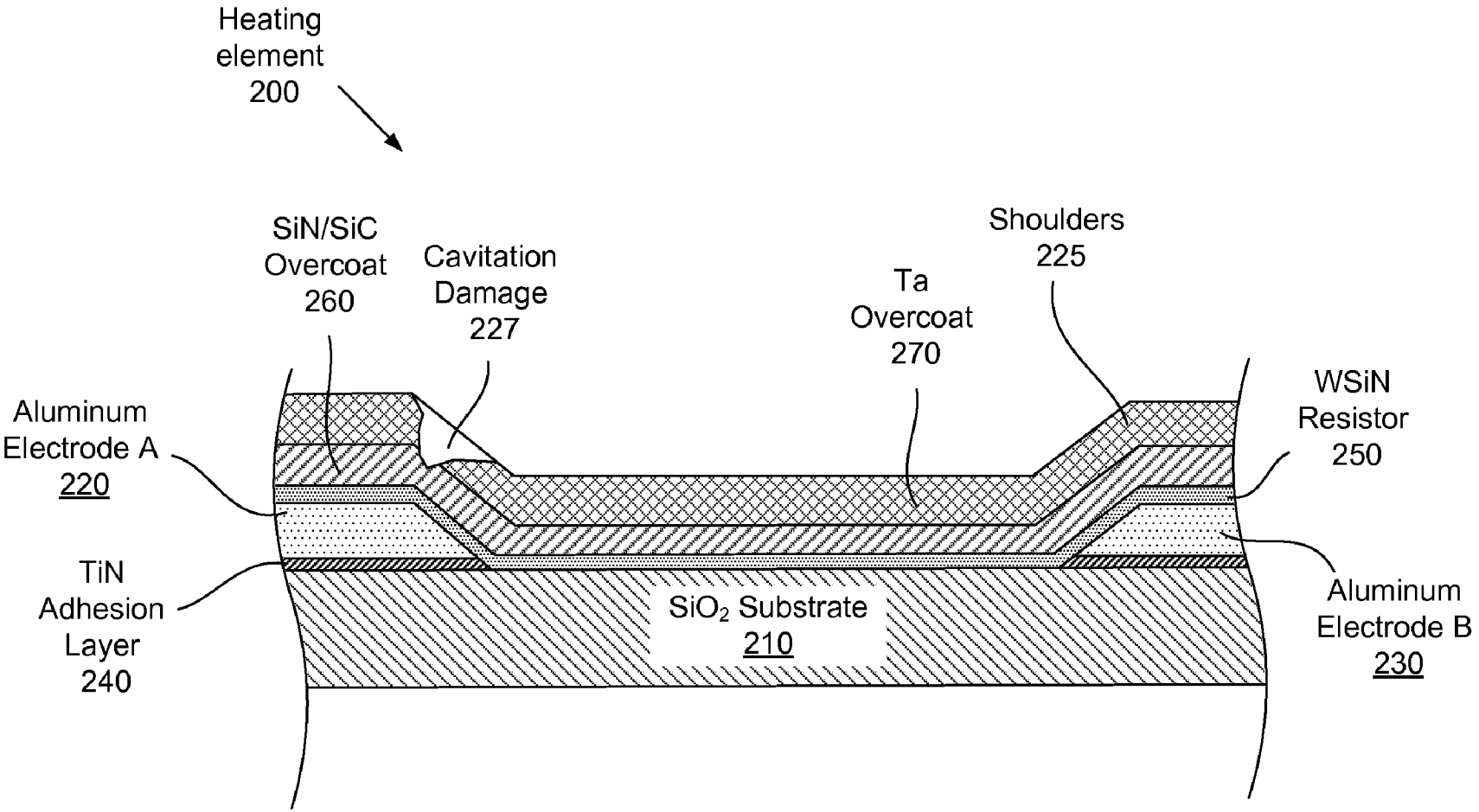
FIG. 2B is a cross-sectional diagram showing a cross-sectional view of an illustrative thermal inkjet resistor with a beveled topography, according to one embodiment of principles described herein.

FIG. 2B is a cross-sectional diagram of an illustrative heating element (200). According to this illustrative embodiment, $SiO_2$ is used as the substrate material (210). Additional layers, which are not illustrated in this figure, may be present below the TEOS layer. A thin layer of titanium nitride (TiN) (240) is used as an adhesion layer to increase the mechanical bonding strength of the overlying layers to the $SiO_2$ substrate (210). Aluminum electrodes (220, 230) are then deposited and shaped by dry ion etching to form beveled edges. According to one illustrative embodiment the dry etch removes the TiN adhesion layer (240) and penetrates the $SiO_2$ substrate (210). A tungsten silicon nitride (WSiN) resistor layer (250) is deposited over the aluminum electrodes (220, 230) and the etched cavity. According to one illustrative embodiment, the resistor layer (250) is created by sputtering a resistive material over the electrodes (220, 230). Due to the line-of-sight sputtering methods, the resistive material can be weaker near the beveled edges. There are several types of materials used to make the resistor layer (250). For example, a tantalum aluminum alloy can be used.

A number of additional overcoat layers can be formed over the WSiN resistor layer (250) to provide additional structural stability and electrically insulate fluid in the firing chamber from the resistor layer (250). In this embodiment, a silicon nitride/silicon carbide overcoat (260) and a tantalum overcoat (270) are deposited over the resistor layer (250). As discussed above, the shoulders (225) can be more susceptible to cavitation damage (227) or other surface erosion. The additional layers (260, 270) are specifically designed to protect the underlying resistor layer (250) from mechanical and other damage. However, due to the beveled topography the additional layers (260, 270) may be weaker in the shoulder regions. For example, tantalum overcoat is susceptible to failure under the impact of bubble collapse in the shoulder region (225). This is related to structural properties of sputter deposited tantalum, and the line-of-sight nature of the sputtering process. The sloped edges of aluminum terminations are almost 45 degree from the normal to the substrate, creating a considerable degree of shadowing among the columnar grains of tantalum as they grow away from the substrate. This promotes inter-granular porosity and weak bonds among the tantalum grains which are susceptible to stresses exerted during bubble collapse. Also, the tantalum layer is almost 30% thinner in these areas. This is because of the almost 45 degree topography in these areas. Since resistor life is proportional to the thickness of Ta, this adversely impacts the reliability of the TIJ device.

Thicker overcoat layers could increase the reliability of the device. However, the additional layers (260, 270) separate the resistor layer (250) from the fluid in the firing chamber and reduce the efficiency and firing frequency in proportion to their thickness.

In the embodiment illustrated in FIG. 2B, resistor layer (250) is in direct contact with underlying substrate. During operation, a significant amount of heat from the resistor layer (250) is dissipated into the $SiO_2$ substrate (210). As discussed above, this energy is lost and can result in thermal management issues.

Throughout the specification and appended claims, the term "nanoflat resistor" refers to a resistive material which is substantially planar, a portion of which overlies a thermally and electrically insulating substrate. According to one illustrative embodiment, a nanoflat resistor includes a nanoporous anodized alumina layer and an overlying planar resistor layer.

Figure 3A:
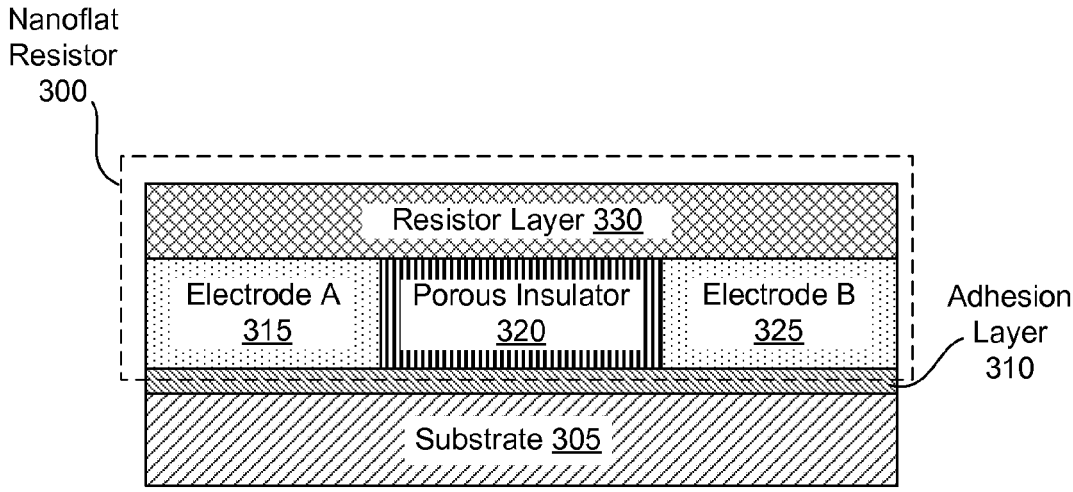
FIG. 3A is a cross-sectional diagram depicting an illustrative nanoflat resistor, according to one embodiment of principles described herein.

FIG. 3A is a cross-sectional diagram of an illustrative nanoflat resistor (300). According to one illustrative embodiment, the nanoflat resistor (300) is formed over a substrate (305) and may have an adhesion layer (310). Two electrodes (315, 325) are separated by a porous insulator (320). The resistive material (330) is deposited over the electrodes (315, 325) and porous insulator (320). The adhesion layer (310) may or may not be present under the porous insulator (320). Particularly, if the adhesion layer (310) is electrically conductive, the portion of the adhesion layer (310) under the porous insulator (320) will be removed or converted into a insulating material to avoid the passage of electrical current between the electrodes (315, 325) through the adhesion layer (310).

Figure 3B:
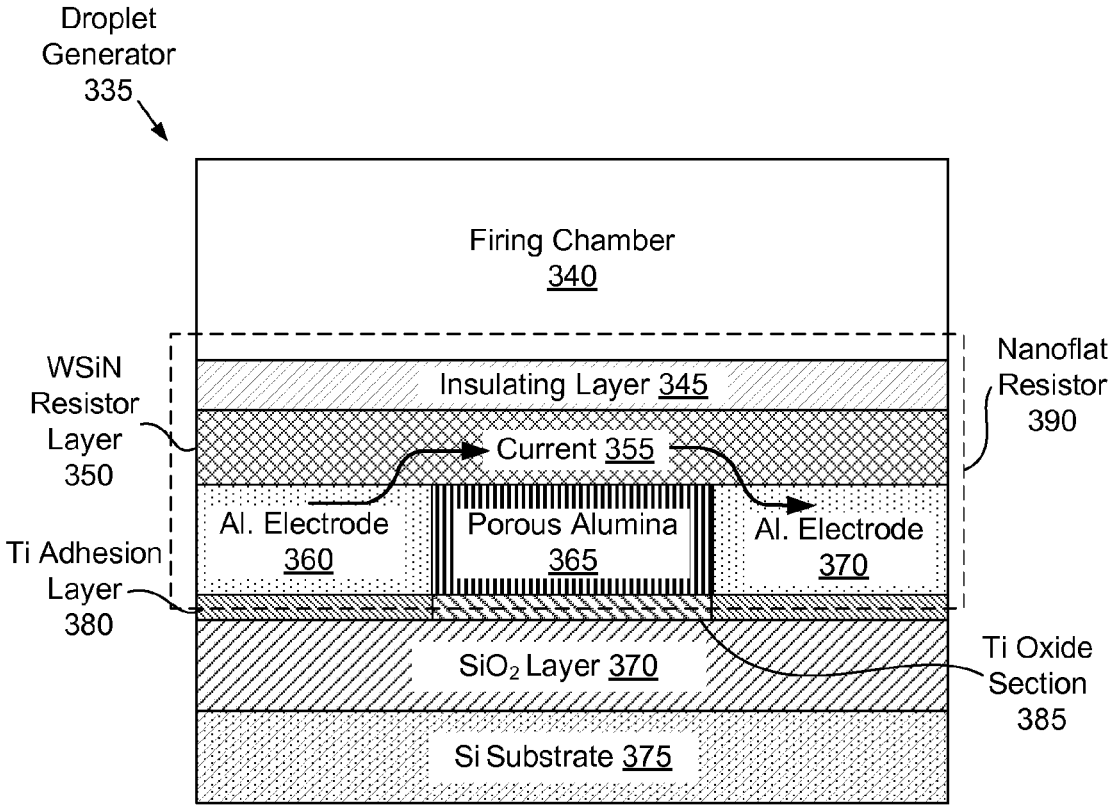
FIG. 3B is a cross-sectional diagram of an illustrative droplet generator which includes nanoflat resistor, according to one embodiment of principles described herein.

FIG. 3B is a cross-sectional diagram of a portion of an illustrative droplet generator (335) which incorporates a nanoflat resistor (390). According to one illustrative embodiment, a Si substrate (375) and $SiO_2$ layer (370) form the base on which the nanoflat resistor (390) is formed. A thin titanium adhesion layer (380) is then deposited. In subsequent processes, a center portion of the titanium adhesion layer (380) is converted into an insulating titanium oxide section (385). Above the titanium layer (380, 385), a layer of aluminum is then deposited and formed into two electrodes (360, 370) and an intervening porous alumina section (385). The porous alumina section (385) is both electrically and thermally insulating. A tungsten silicon nitride (WSiN) resistor layer (350) is formed over the aluminum electrodes (360, 370) and porous alumina section (365). An insulating layer (345) is then deposited over the resistor layer (350) to electrically isolate it from the firing chamber (340).

A voltage is applied across the aluminum electrodes (360, 370). In FIG. 3B, the resulting electrical current is illustrated as flowing through the left aluminum electrode (360) and into the resistor layer (350). The current flows through the central portion of the resistor layer (355) and into the right aluminum electrode (370). As a result, the central portion of the resistor layer becomes heated. The porous alumina section (365) contains nano-pores which will effectively reduce the heat capacity underneath the heated portion of the resistor layer (350). The porous alumina (365) is also a relatively good thermal insulator. For example, the thermal conductivity of aluminum is approximately 250 Watts per meter Kelvin (W/(m*k)) while the thermal conductivity of alumina is approximately 18 W/(m*K). The anodic alumina may have an even lower thermal conductivity than bulk alumina due to a different structure and porosity. For example, some anodized alumina has been determined to have a thermal conductivity of 1.3 W/(m*K) or less. Additionally, the porous nature of the alumina section (365) creates a much smaller cross-sectional area for conducting heat away from the resistor layer (355). The porous alumina section (365) serves a thermally insulating layer which can prevent some of the heat generated by the resistor layer (350) from traveling back into the underlying layers and the mechanical structure of the thermal inkjet head. This directs more of the heat into the firing chamber. Consequently, the resistor layer (350) can be heated more rapidly and with less current. This configuration of a nanoflat resistor (390) can be much more energy efficient in generating droplets.

The reduction of thermal energy stored under the resistive layer (350) allows for faster thermal recovery and cool down between firings. More rapid cool down can significantly increase the frequency at which the droplet generator can operate and increase the printing speed of the thermal ink jet device.

Additionally, the nanoflat resistor (390) has a substantially planar surface which can be more robust than resistor configurations with discontinuities such as shoulders or beveled geometries. The planar surface of the nanoflat resistor (390) can be more robustly constructed and more uniformly distributes stresses from vapor bubble expansion and collapsing. This can increase the lifetime of the resistor and the thermal inkjet print head. In some embodiments, the number or thickness of protective overcoats can be reduced, which can increase the thermal efficiency and firing frequency of the droplet generator.

The figures are not drawn to scale and are not representative of the thickness of layers or relative thickness of layers. Further, the figures are not meant to be an accurate representation of all the layers used to form a thermal ink jet printhead. For example, one or more layers which protect against cavitation damage may be present.

FIGS. 4A-4D are a series of cross-sectional diagrams which show one illustrative method for fabricating a nanoflat resistor. According to one illustrative embodiment illustrated in FIG. 4A, an adhesion layer (415) and an aluminum layer (410) are deposited over a substrate (405). According to one illustrative embodiment, the adhesion layer (415) is a thin layer of titanium deposited over a $SiO_2$ substrate. In one embodiment, the titanium layer is approximately 10 nm (nanometers) thick. As mentioned above, the purpose of the titanium layer is to serve as an adhesive layer for aluminum layer (410).

Figure 4A:
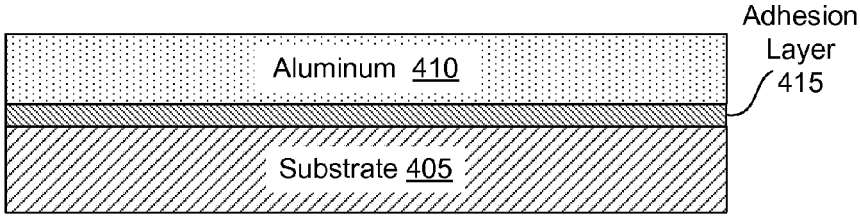
FIGS. 4A-4D are cross-sectional diagrams of illustrative stages in the construction of a nanoflat resistor, according to one embodiment of principles described herein.
Figure 4B:
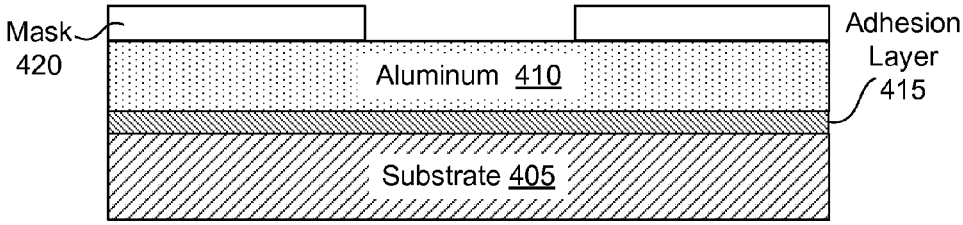

FIG. 4B shows a mask (420) which is placed over the aluminum. According to one illustrative embodiment, the mask (420) is a patterned photoresist layer. The mask (420) contains openings (422) which are placed over areas of the aluminum which are to be converted into nanoporous aluminum. Sections of the aluminum layer (410) which are protected by mask (420) will not be anodized.

Figure 4C:
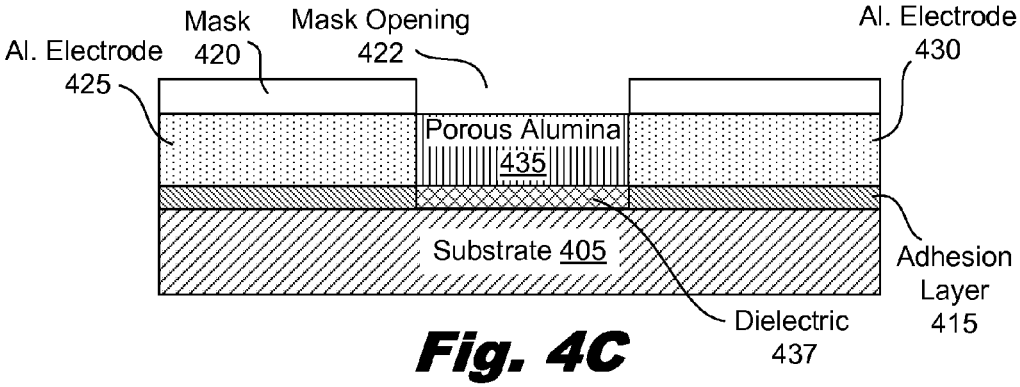

FIG. 4C shows the exposed aluminum converted to a section of porous alumina (435). As discussed above, the porous alumina (435) has a nanoporous structure and serves as an electrical and thermal insulator. The porous alumina section (435) divides the aluminum layer (410) into two electrodes (425, 430). According to one illustrative embodiment, the aluminum (410, FIG. 4B) is converted to porous alumina using an anodization process. Ideally, the anodization process would etch the exposed aluminum all the way down to an underlying insulating layer. This is to prevent the electrical current from leaking through from one side of the anodized aluminum to the other without passing through the resistor material above.

Figure 4D:
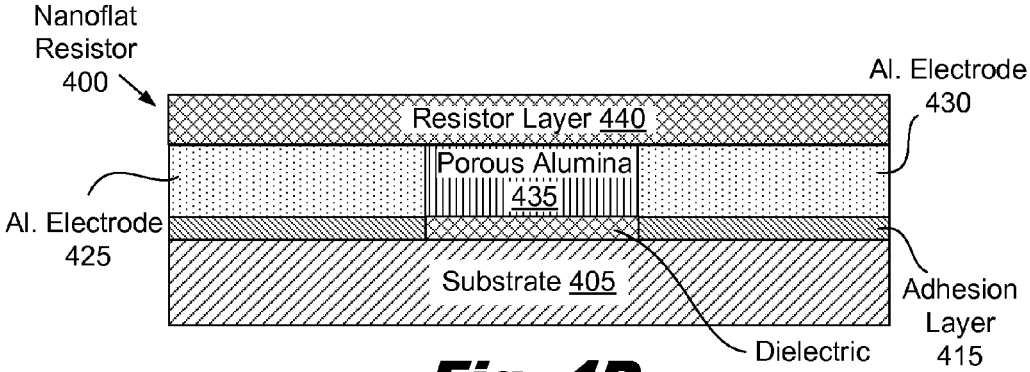

FIG. 4D shows a step in which the mask was removed and a resistor layer (440) which was deposited above the aluminum electrodes (425, 430) and porous alumina (435) to form the nanoflat resistor (400). The mask can be removed using a variety of subtractive techniques, but is typically chemically dissolved. After the mask has been removed, the resistive layer (440) is deposited on the relatively flat surface of aluminum/porous alumina. In one illustrative embodiment, a resistive material such as WSiN is sputtered on top of the aluminum and anodized aluminum to form the resistive layer (440).

As mentioned above, the relative dimensions in the figure are not necessarily to scale. The thickness of each layer will have various effects on the efficiency of the nanoflat resistor. For example, the thickness of the resistor layer (440) will determine the exact resistivity of the resistor. The thickness of the aluminum layer (425) will determine how well the aluminum will conduct electrical current. The thickness of overlying layers may be determined by balancing any increase in the life of the nanoflat resistor against the thermal resistance the overlying layers introduce between the resistor layer (440) and the fluid in the firing chamber.

Figure 5A:
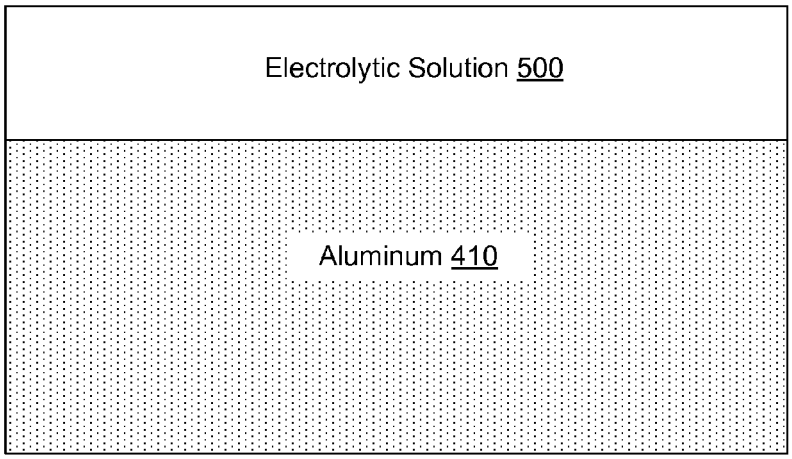
FIGS. 5A and 5B are diagrams of an illustrative aluminum anodization process, according to one embodiment of principles described herein.
Figure 5B:
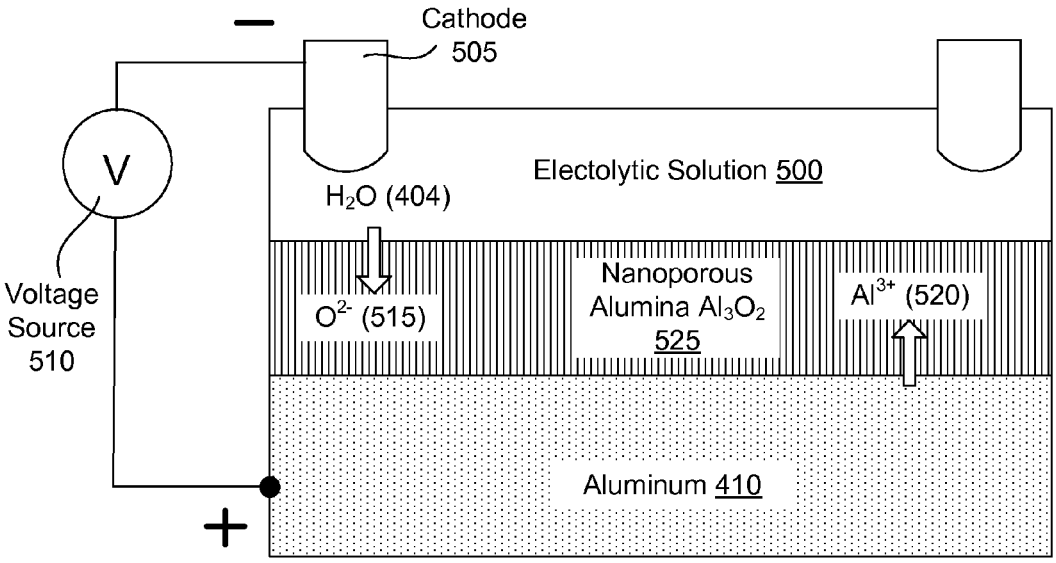

FIGS. 5A and 5B are diagrams which show an illustrative anodizing process which converts the exposed aluminum into nanoporous alumina. FIG. 5A shows an electrolytic solution (500) over an aluminum surface (410). An electrolytic solution contains free ions and is electrically conductive. A variety of electrolytic solutions (500) may be used, including, but not limited to, sulfuric acid ($H_2SO_4$), phosphoric acid ($H_3PO_4$), chromic acid, sulfosalicyclic acid, oxalic acid ($H_2C_2O_4$), and their mixtures.

FIG. 5B is a diagram which shows an illustrative chemical reaction which forms nanoporous alumina. The anodization process converts aluminum, or aluminum alloys into non-conducting alumina. According to one illustrative embodiment, the aluminum may have approximately 0.5 weight percent of copper. During the manufacturing process, a voltage source (510) is connected between the aluminum (410) and a cathode (505). In this example, the aluminum (410) serves as the anode. When a voltage is applied across the aluminum (410) and the cathode (505), a current runs through the electrolytic solution (500). The flow of electrical current in the electrolytic solution (500) causes hydrogen to be released at the cathode and oxygen (515) to be released at the anode. The oxygen atoms (515) combine with the aluminum atoms (520) to create nanoporous anodized aluminum (525) denoted $Al_3O_2$. The anodic oxidation of aluminum involves formation of self-organized array of nanopores arranged over the surface of the alumina. If carried through to completion, the anodization extends through the thickness of the aluminum layer. Tests have shown minimal current leakage through the nanoporous alumina when it extends completely through the aluminum layer.

According to one illustrative embodiment, the anodization of a thermal inkjet die may be performed using a 2% oxalic acid solution at room temperature and applying 30 volts across the electrolytic solution, with the aluminum serving as the cathode.

Figure 6:
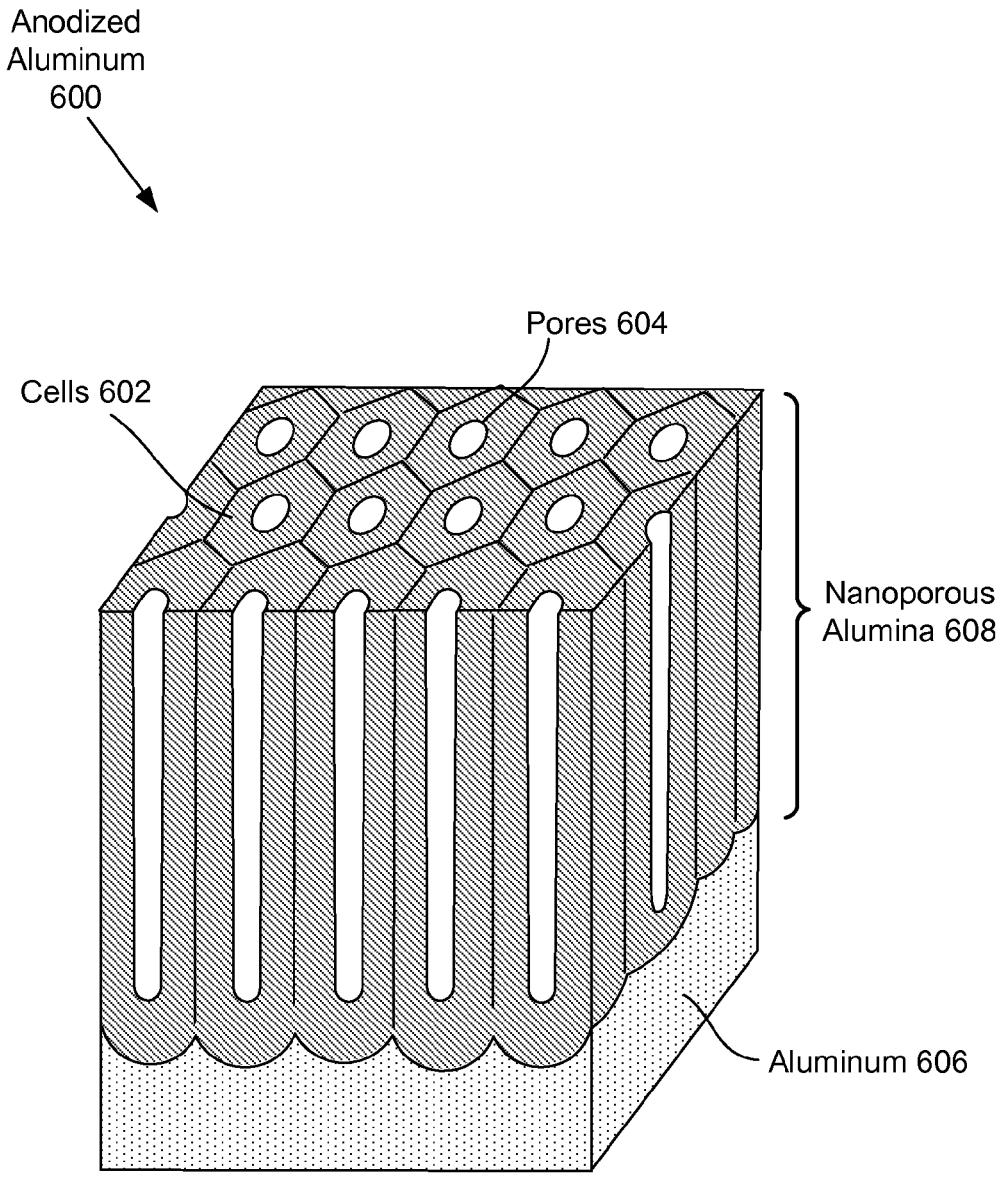
FIG. 6 is a cutaway perspective view of an illustrative nanoporous anodized alumina structure, according to one embodiment of principles described herein.

FIG. 6 is a cross-sectional diagram of one illustrative embodiment of anodized aluminum (600). Under the appropriate conditions, a highly ordered configuration of nanoporous alumina (608) is formed from the aluminum (606). The nanoporous alumina (608) includes closely packed array of hexagonal shaped columnar cells (602). These cells each have central, cylindrical, nano-pores (604). These nano-pores typically range from 4-200 nanometers in diameter.

The exact diameter of the nano-pores (604) may depend on the type of electrolytic solution, applied voltage, current density, temperature, and other factors. The more porous the anodized aluminum (600) is, the lower its thermal conductivity will be, thus increasing the thermal isolation of the resistor layer and lowering the amount of energy which is required to propel a droplet of ink onto a substrate. Further, by making the anodized aluminum more porous, its heat capacity is decreased, which leads to more rapid droplet ejection cycles.

Figure 7A:
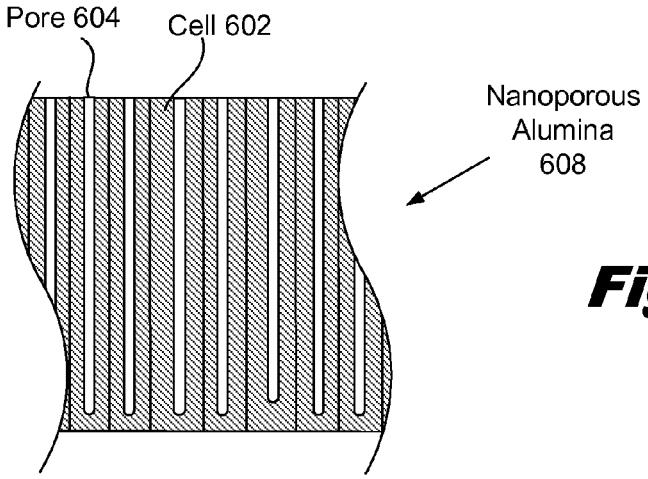
FIGS. 7A-7C are cross-sectional diagrams of an illustrative wet etching process which enlarges the pores in a nanoporous anodized alumina structure, according to one embodiment of principles described herein.

According to one illustrative embodiment, the heat capacity and the thermal conductivity of the nanoporous alumina (608) can be further lowered by enlarging the pore diameters. FIG. 7A is a cross-sectional diagram of a nanoporous alumina layer (608) after the anodization process has been complete. According to one illustrative embodiment, the pores are approximately 1 micron in depth and approximately 20 nanometers in diameter. The pores (604) are significantly smaller than the cells (602). Consequently, the solid walls of the cells (602) have a relatively thick cross-section. The nanoporous alumina shown in this figure may have a porosity between 7% and 20%. These solid walls represent the cross-sectional area which absorbs and conducts heat away from the overlying resistor layer (not shown). By increasing the pore diameters, the wall thickness is reduced and the nanoporous alumina (608) becomes a better thermal insulator.

Figure 7B:
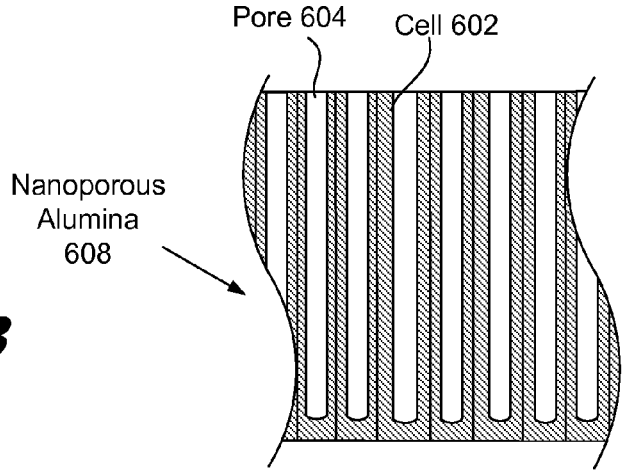
Figure 7C:
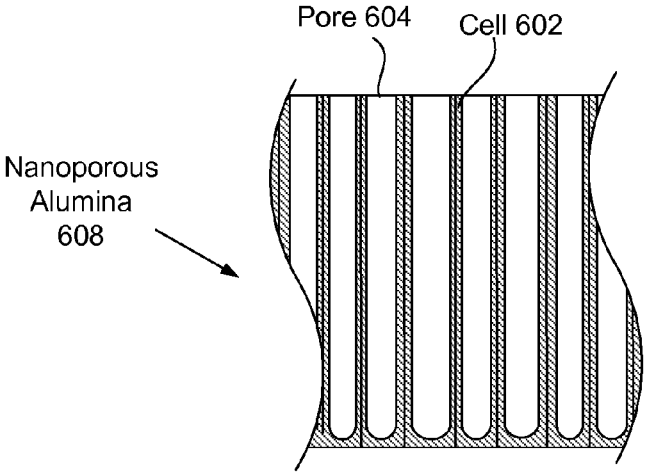

According to one illustrative embodiment, a wet etchant such as phosphoric acid can be used to increase the pore diameters. FIGS. 7B and 7C show the progressive enlargement of the pore diameters during etching. FIG. 7B represents an illustrative enlargement of the pore diameters after 10 minutes of etching in 5% by volume phosphoric acid at 30° C. The pore sizes have increased to approximately double their previous diameter and the porosity has been increased to approximately 25%. FIG. 7C represents a sample which has been etched in the same solution and at the same temperature for 30 minutes. The pore diameters have been increased significantly and the porosity of the alumina has been increased to 60% or greater.

Figure 8:
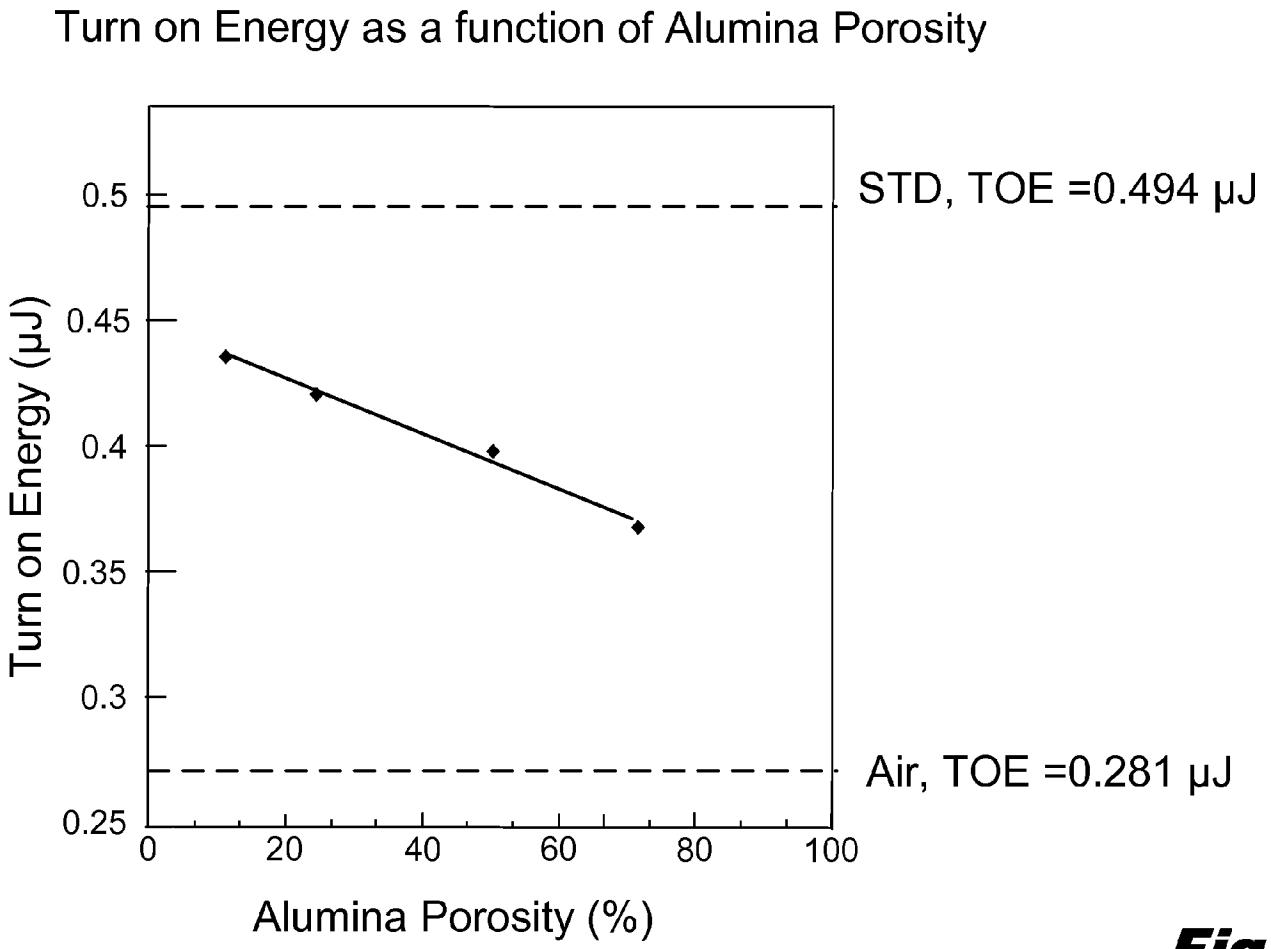
FIG. 8 is a graph showing the turn on energy of a nanoflat resistor as a function of the porosity of the nanoporous anodized alumina, according to one embodiment of principles described herein.

FIG. 8 is graph showing the turn on energy of a nanoflat resistor as a function of the porosity of the nanoporous anodized alumina. As discussed above, as the density of the nanoporous alumina decreases, its thermal conductivity and thermal capacitance decrease. This decreases the energy lost from the substrate side of the nanoflat resistor and allows it to heat up more quickly and with less energy.

As used in the specification and appended claims, the term "turn on energy" refers to the minimum amount of electrical energy applied to a nanoflat resistor or other heating element that produces an ink droplet of a predetermined size. The vertical axis of graph shows turn on energy in micro-Joules. The horizontal axis of the graph shows the porosity of the nanoporous alumina, with a porosity of 0% indicating an alumina layer without pores and a porosity of 100% indication an air space under the nanoflat resistor.

Two horizontal dashed lines show the Turn On Energy (TOE) for various alternative heating element configurations. The upper dashed line, labeled "STD, TOE=0.494 μJ" indicates that the turn on energy for a standard configuration, such as that illustrated in FIG. 2B is approximately 0.494 micro-Joules. The lower horizontal dashed line, labeled "Air, TOE=0.281 μJ" indicates that the turn on energy for a configuration with an air cavity under the resistive layer has a turn on energy of approximately 0.281 micro-Joules. The construction of an air cavity beneath a resistive layer may have several challenges including high production costs and reduced strength.

As can be seen from the graph in FIG. 8, the turn on energy decreases as the porosity of the alumina increases. For example, at a first data point, the porosity of the alumina is approximately 15% and the turn on energy is approximately 0.43 micro-Joules. As discussed above with respect to FIGS. 7A-7C, a wetting etching process or other process can be used to enlarge the pores of the nanoporous alumina, thereby increasing its porosity. Additional data points shown by diamonds represent measurement of turn on energies for progressively increasing porosities. The right most data point represents a porosity of approximately 75% which has a turn on energy of approximately 0.350 micro-Joules. A diagonal solid line is a curve fit to the graphed data points.

Figure 9:
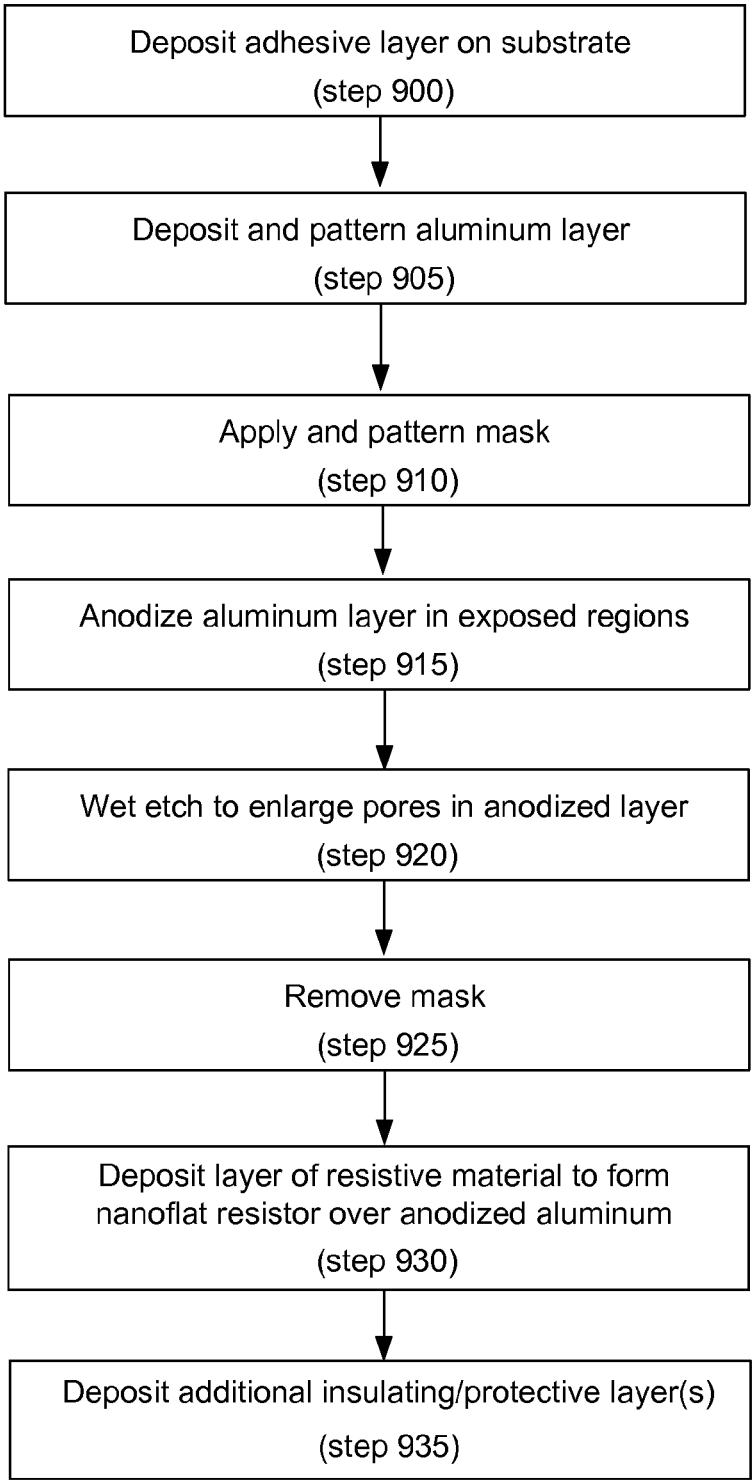
FIG. 9 is flow chart showing an illustrating process for manufacturing a nanoflat resistor, according to one embodiment of principles described herein.

FIG. 9 is a flow chart showing one illustrative method for manufacturing a nanoflat resistor. In a first step, an adhesive layer is deposited on a substrate (step 900). The substrate may be any of a number of materials or combinations of materials. For example, the substrate may be made up of one or more of silicon, silicon dioxide, electrically conductive traces, vias, CMOS circuitry, etc. According to one illustrative embodiment, the upper surface of the substrate may have an insulating or planarization layer which is made up of $SiO_2$. The adhesive layer itself is not required and can be omitted if the overlying layer has a sufficient mechanical adhesion with the substrate. The adhesive layer may be any of a number of materials, including titanium, titanium alloys, tantalum, tantalum alloys, chromium, chromium alloys, aluminum or aluminum alloys. According to one illustrative embodiment, a thin layer of titanium is deposited over a $SiO_2$ insulation layer. The adhesive layer may be patterned and, in some embodiments, may not be present at the location where the nanoporous material will be formed.

A layer of aluminum is then deposited and appropriately patterned (step 905). The layer of aluminum can be pure aluminum or aluminum alloys. For example, a small amount of copper may be included in the aluminum to make the metal better suited to conduct an electrical current. According to one illustrative embodiment, a continuous planar layer of aluminum extends under the area where the nanoflat resistor will be formed. The mask is then applied and patterned (step 910) to expose one or more portions of the aluminum layer. The exposed portions of the aluminum layer are then anodized (step 915) as described above. According to one illustrative embodiment, the aluminum is anodized to create a nanoporous structure which extends through the thickness of the aluminum layer. This is to prevent current from leaking through the aluminum as opposed to flowing through the resistor material. The anodizing process may slightly increase the thickness of the anodized aluminum relative to the non anodized aluminum. This change in thickness is typically small and gradual.

The nanoporous structure may then be wet etched as described above to enlarge the pore diameters of the nanoporous structure (step 920). Various parameters can be controlled during the wet etching process to obtain the nanoporous structure. For example, the composition of the etchant solution, the time, temperature, and other factors may be controlled. In some circumstances, the wet etching process may be omitted and the anodized nanoporous structure may be used without pore enlargement.

The mask is removed (step 925) to expose two aluminum electrodes which are separated by the anodized nanoporous section. A layer of resistive material may then be deposited over the aluminum to form a nanoflat resistor (step 930). According to one illustrative embodiment, the resistive material is sputtered onto the underlying layers. As mentioned above, the anodizing process may slightly increase the thickness of the anodized alumina relative to the non anodized aluminum. This increase in height can be naturally compensated during the deposition of the resistor layer. During deposition, the resistor material extends a short distance into the nanopores. This naturally reduces the thickness of the resistor layer to compensate for the increased height of the anodized alumina and produces a smooth monolithic surface resistor surface. According to one illustrative embodiment, the pore sizes may be selected to produce this natural compensation for the increased height of the anodized alumina.

In optional steps, the surface may be planarized or a capping layer can be formed over the nanoporous section prior to the deposition of the resistive layer. The capping layer may serve as a sealant which closes the nanopores before the resistive material layer is in place. According to one illustrative embodiment, the capping layer may be used with larger pore sizes. This can help protect the nanopores from any unwanted material getting inside and reducing the effectiveness of the pores. As mentioned above, the sealant step may be skipped and the resistive material can serve as a sealant.

By way of example and not limitation, the resistive material may be tungsten silicon nitride. Additional insulating and/or protecting layers may then be deposited over the nanoflat resistor (step 935). For example, these insulating/protective layers may include silicon nitride, silicon carbide, tantalum, other materials, or combinations thereof.

An additional advantage to the fabrication of a heating resistor embodying principles described in this specification is that many of the steps are similar to the fabrication of traditional dry etch heating resistors. According to one illustrative embodiment, the anodization process can be substituted for the dry etching process, with the remainder of the steps remaining the same. Thus the cost to implement manufacturing of nanoflat resistors is minimized.

In sum, to increase the performance of a thermal inkjet device heating resistor, two main factors are considered. First, the efficiency at which the resistor transfers electrical energy into thermal energy, and second, the reliability of the resistor. The efficiency at which energy is transferred can be accomplished by reducing the heat capacity of the material underneath the resistor. The heat capacity can be reduced by making the material more porous. The aluminum underneath the resistor can be made porous through anodizing. This decreases the turn on energy of the droplet generator and increases the frequency at which the droplet generator can operate. The life of the nanoflat resistor is extended by the flat monolithic topography of the resistor layer.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A nanoflat resistor comprises:

a first aluminum electrode;

a second aluminum electrode;

nanoporous alumina separating the first and second aluminum electrodes; and a substantially planar resistor layer overlying the first and second aluminum electrodes and nanoporous alumina;

in which an electrical current passes from the first aluminum electrode, through a portion of the planar resistor layer overlying the nanoporous alumina, and into the second aluminum electrode.

2. The resistor according to claim 1, in which the first aluminum electrode, second aluminum electrode, and nanoporous alumina are formed from a continuous layer of aluminum.

3. The resistor according to claim 1, in which the nanoporous alumina extends completely through the thickness of the aluminum layer.

4. The resistor of according to claim 1, further comprising an adhesion layer, the adhesion layer being interposed between the substrate and the first and second aluminum electrodes.

5. The resistor according to claim 4, in which the adhesion layer is a titanium layer, a portion of the titanium layer underlying the nanoporous alumina being converted to titanium dioxide.

6. The resistor according to claim 1, in which pores within the nanoporous alumina are substantially perpendicular to the resistor layer.

7. The resistor according to claim 1, in which pores within the nanoporous alumina are enlarged by wet etching.

8. The resistor according to claim 1, further comprising a capping layer, the capping layer sealing an upper surface of the nanoporous alumina.

9. The resistor according to claim 1, in which the planar resistor layer has an upper surface and a lower surface, the upper surface and the lower surface being substantially parallel and substantially planar.

10. The resistor according to claim 1, further comprising one or more of: a cavitation resistant overcoat and an electrically insulating overcoat.

11. A method for constructing a nanoflat resistor comprises:

depositing an aluminum layer over a substrate layer;

anodizing a portion of the aluminum layer to form nanoporous alumina;

the aluminum layer comprising a first aluminum electrode and a second aluminum electrode which are separated by the nanoporous alumina; and depositing a resistor layer over the first and second aluminum electrodes and the nanoporous alumina such that an electrical current passes from the first aluminum electrode, through a portion of the resistor layer overlying the nanoporous alumina and into the second aluminum electrode.

12. The method according to claim 11, further comprising the step of depositing an adhesive layer over the substrate layer prior to deposition of the aluminum layer.

13. The method according to claim 11, further comprising the step of applying a mask layer, the mask layer comprising apertures which expose portions of the aluminum layer which are to be anodized.

14. The method of according to claim 11, in which anodizing a portion of the aluminum layer forms nanopores which are perpendicular to plane of substrate; the nanoporous alumina extending through the thickness of the aluminum layer.

15. The method of according to claim 14, further comprising the step of wet etching nanoporous alumina to enlarge the nanopores.

16. The method according to claim 12, further comprising the step of applying a mask layer, the mask layer comprising apertures which expose portions of the aluminum layer which are to be anodized.

17. The method of according to claim 12, in which anodizing a portion of the aluminum layer forms nanopores which are perpendicular to plane of substrate; the nanoporous alumina extending through the thickness of the aluminum layer.

18. The method of according to claim 17, further comprising the step of wet etching nanoporous alumina to enlarge the nanopores.

19. The method of according to claim 13, in which anodizing a portion of the aluminum layer forms nanopores which are perpendicular to plane of substrate; the nanoporous alumina extending through the thickness of the aluminum layer.

20. The method of according to claim 19, further comprising the step of wet etching nanoporous alumina to enlarge the nanopores.

* * * * *

UNITED STATES PATENT AND TRADEMARK OFFICE

CERTIFICATE OF CORRECTION

PATENT NO. : 8,390,423 B2
APPLICATION NO. : 13/321461
DATED : March 5, 2013
INVENTOR(S) : Arjang Fartash et al.

It is certified that error appears in the above-identified patent and that said Letters Patent is hereby corrected as shown below:

In the Claims:

In column 11, line 1, in Claim 4, delete "of according" and insert -- according --, therefor.

In column 12, line 10, in Claim 14, delete "of according" and insert -- according --, therefor.

In column 12, line 14, in Claim 15, delete "of according" and insert -- according --, therefor.

In column 12, line 21, in Claim 17, delete "of according" and insert -- according --, therefor.

In column 12, line 25, in Claim 18, delete "of according" and insert -- according --, therefor.

In column 12, line 28, in Claim 19, delete "of according" and insert -- according --, therefor.

In column 12, line 32, in Claim 20, delete "of according" and insert -- according --, therefor.

Signed and Sealed this
Second Day of July, 2013

Teresa Stanek Rea
*Acting Director of the United States Patent and Trademark Office*